United States Patent [19]

O'Gara

[11] Patent Number: 4,938,041

[45] Date of Patent: Jul. 3, 1990

[54] LOCKING ASSEMBLY FOR A DOOR STRUCTURE

[76] Inventor: James O'Gara, 444 W. 258th St., Riverdale, N.Y. 10471

[21] Appl. No.: 369,537

[22] Filed: Jun. 20, 1989

[51] Int. Cl.[5] ..... E05B 65/08

[52] U.S. Cl. ..... 70/95; 70/33

[58] Field of Search ..... 70/91, 95, 101, 32, 70/33, 34, 237, 14; 292/288, 289

[56] References Cited

U.S. PATENT DOCUMENTS

| | | | |
|---|---|---|---|
| 1,079,860 | 11/1913 | Kiehl | 292/289 |
| 1,598,081 | 8/1926 | Japs | 292/289 |
| 3,769,821 | 11/1973 | Randel | 70/33 |
| 3,899,905 | 8/1975 | Walters | 70/91 |
| 3,996,774 | 12/1976 | Best | 70/34 |
| 4,506,527 | 5/1985 | Grill | 70/101 |
| 4,790,159 | 12/1988 | Quinn | 70/91 |

*Primary Examiner*—Robert L. Wolfe
*Attorney, Agent, or Firm*—Herbert Dubno

[57] ABSTRACT

A door structure having a stationary portion and a hinged portion swingable into an open position has a locking assembly with a strap mounted on the door structure along at least two adjoining sides thereof and formed with a projection adjacent a separation between the portions and extending substantially parallel to an opening swing of the hinged portion, the projection being formed with at least one aperture, and a lock removably mounted on the projection and having a shaft traversing the aperture, the lock having a body which extends across the separation between the portions, blocking both portions of the door structure and acting to prevent the opening swing of the hinged portion.

14 Claims, 4 Drawing Sheets

LOCKING ASSEMBLY FOR A DOOR STRUCTURE

FIELD OF THE INVENTION

The present invention relates, in general, to locking assemblies for door structures, and, more particularly, to add-on locking assemblies for door structures for providing additional security.

BACKGROUND OF THE INVENTION

Add-on locking assemblies for automotive or building use are well known in the art and usually comprise a two-part hasp, with one part mounted on a surface of a stationary portions of a door structure and the other part mounted on a surface of a movable portion of the door structure, one of the parts of the hasp being formed as an eye which traverses a slot formed in the other part, a padlock being used to engage the eye and lock the assembly, the anchoring of the hasp parts to the surfaces being done with bolts or screws or the like.

In another version of the known assemblies, a pair of identical hasps are used, one mounted on the surface of either portion of the door assembly, each hasp being L-shaped and each having a flange projecting outwardly from the door structure adjacent one another and each formed with a respective aperture in alignment with one another and traversed by the shaft of a lock of the type having a cylindrical body formed with an elongated groove across which the shaft can move transversely, the two flanges fitting into the groove. As an alternative to the cylindrical type lock, a padlock can be used with the shackle thereof passing through the apertures.

A number of security disadvantages are encountered with these types of locking assemblies, namely, the surface mounted hasps are prone to being pried off the mounting surfaces either entirely or to the extent that a saw blade or bolt cutter can be inserted between the surface and the hasp, and the mounting bolts severed. Alternatively, a hammer and chisel can be used to remove the heads from the bolts, or the bolt cutter or saw blade can be used to sever the shackle of the padlock.

While the cylindrical-bodied lock offers the best protection against a direct attack on the lock shackle or shaft itself, the body of the lock presents a special disadvantage when used with surface mounted hasps in that the rather large cylindrical body provides an ideal structure behind which a pry bar can be inserted and brought to bear, separating the hasps from the mounting surfaces.

OBJECTS OF THE INVENTION

It is therefore an object of the present invention to provide an improved locking assembly adapted to obviate the aforementioned disadvantages.

It is another object of the invention to provide an improved locking assembly in which the hasps or straps thereof are mounted on the door structure in a manner which is substantially impervious to forced entry.

It is still another object of the invention to provide an improved locking assembly in which only a single strap is used on door structures whose moving portions are hinged.

SUMMARY OF THE INVENTION

The above and other objects of the invention are met in a first embodiment of the locking assembly which is directed toward automotive use in a van of the type in which the door structure comprises a stationary upright portion flanked by a hinged door swingable into an open position and a sliding door slidable into an open position.

The locking assembly comprises an h-shaped strap which straddles the stationary upright with a pair of flanges joined by a web, the flanges flanking the upright on two opposite sides thereof and traversed by at least one mounting bolt, both ends of which are covered by the respective hinged and sliding doors in the closed positions thereof, the h-shaped strap being further formed with a first projection extending outwardly from the upright adjacent the separation between the upright and the hinged door, the first projection being substantially parallel to the opening swing of the door.

An L-shaped strap is mounted on the sliding door and has a second projection which lies adjacent the first projection in the closed position of the sliding door, the L-shaped strap being formed by a single unitary strip folded at the projection to form a double layer coextending to a pair of ends remote from the second projection, one end of the pair of ends being pointed for driving the associated layer thereof into an edge of the sliding door, whereby the double layers straddle a layer or skin of the door, with at least one other mounting bolt traversing the double layers and skin.

As an alternative, the L-shaped strap can be formed without a pointed end, in which case an opening is formed in the edge of the door and one layer of the double layer is inserted through this into the door, with all of the other features remaining the same.

The first and second projections are each formed with an aperture in axial alignment with one another and traversed by the shaft of a lock of the type having a cylindrical body formed with an elongated groove into which the projections fit, the body of the lock extending across the separation between the hinged door and the stationary upright and blocking the opening swing of the hinged door, while at the same time, the lock acts to keep the first and second projections of the respective straps together, preventing the opening of the sliding door.

In a second embodiment of the invention, the locking assembly is directed to hinged doors, wherein the single strap is F-shaped and has a pair of opposing flanges joined by a web which fits around the edge of a stationary portion of the door structure, which in this case can be double doors with one door being held stationary, both flanges and the stationary portion being traversed by a mounting bolt, the strap having a projecting tail in which either a single aperture is formed to be used with a cylindrical-bodied lock, or a pair of apertures to accommodate a short-shackled padlock, whose body extends across the separation between the stationary portion and the hinged door and can act to block the opening swing thereof.

In a variation of the second embodiment, the door structure comprises a single hinged door set in a door frame having a shoulder acting as a stop for the swinging door, in this case the locking assembly including a T-shaped strap in which the cross of the T extends between the separation between door and frame from the shoulder of the frame to beyond the frame to form the projection, while the leg of the T defines a flange bolted to the frame, the portion of the cross which lies between door a frame also being traversed by a number of screws threadedly engaged in the frame. Once again, the projection can be formed with an aperture traversed by the cylindrical-bodied lock, which acts to block the opening swing of the hinged door.

Any attempt at forced entry with any of these embodiments of the locking system would be difficult in the extreme, if not impossible, since the basic configurations of the various straps always straddle some portion of the door structure, so that any attempt to pry off a strap would require destruction of a substantial portion of the door structure, since the straps themselves are made of hardened steel and not easily bent. The straps can also be dimensioned so that any bolt heads are covered by the body of the lock.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
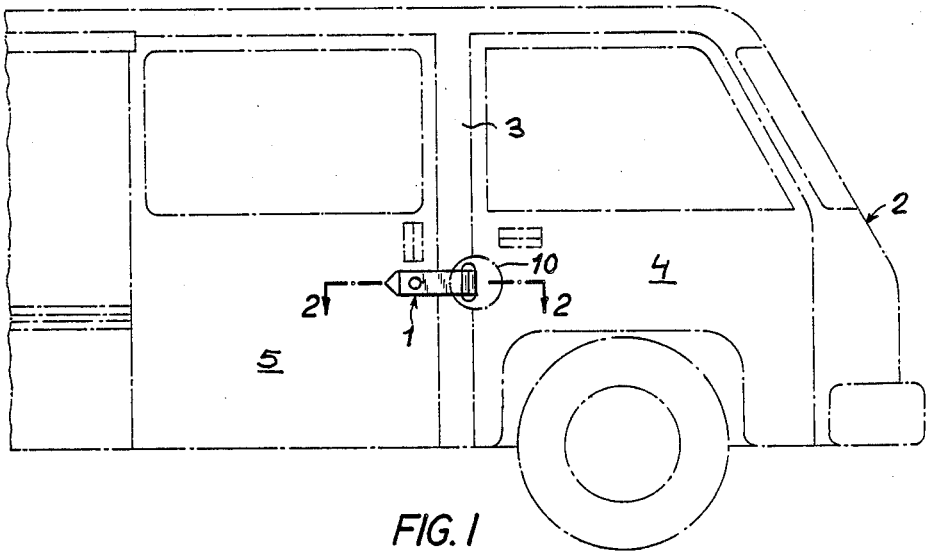
FIG. 1 is a somewhat diagrammatic side elevational view of the locking assembly according to the invention, mounted on a van shown in phantom lines.
Figure 2:
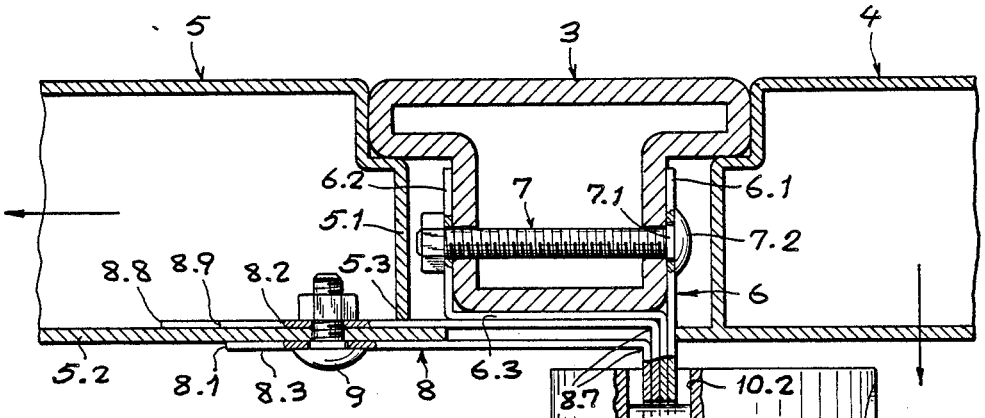
FIG. 2 is a sectional view taken along line II—II of FIG. 1.

FIGS. 1–4 illustrate a first embodiment of a locking assembly 1 which is directed to automotive use and is shown mounted on a van 2 having a door structure comprising a stationary upright portion 3 flanked respectively by a hinged door 4 swingable into an open position, and a sliding door 5 slidable into an open position.

The locking assembly 1 comprises an h-shaped strap 6 which straddles the stationary upright 3 with a pair of respective flanges 6.1 and 6.2 joined by a web 6.3, the flanges 6.1 and 6.2 being traversed by a carriage bolt 7 which mounts the strap 1 on the upright 2.1, the bolt 7 having a square boss 7.1 formed at the plain unmarked head 7.2 thereof, the boss 7.1 being held against rotation in the square opening 6.4 formed in the flange 6.1. The strap 6 is formed by a single unitary strip, with the flange 6.1 extending outwardly from the upright 3 beyond the web 6.3 to where it is folded over and extends back to the web 6.3 and forms a double layered projection 6.5 formed with an aperture 6.6.

The locking assembly 1 further comprises an L-shaped strap 8 mounted on the sliding door 5 and also has a projection 8.5 which lies adjacent the other projection 6.5 in the closed position of the door 5, the strap 8 being formed by a single unitary strip folded at the projection 8.5 to form a double layer 8.2 and 8.3 coextending to a pair of respective ends 8.9 and 8.1, the end 8.9 having a point 8.6 for driving the layer 8.2 into the edge 5.1 of the door 5 and straddling a layer or skin 5.2 thereof, the layers 8.2 and 8.3 and the skin 5.2 being traversed by another mounting bolt 9 similar to the bolt 7, the strap 8 being held against rotation around the bolt 9 by the slot 5.3 formed in the edge 5.1 when the layer 8.2 is driven therein. Further, the strap 8 is bent at 8.7, whereby the projection 8.5 extends at a right angle, parallel to the projection 6.5, and is formed with an aperture 8.6 coaxial with the aperture 6.6.

A lock 10 has a cylindrical body 10.1 in which an elongated groove 10.2 is formed, across which a shaft 10.3, operated by a lock cylinder 10.4, can move transversely through the apertures 6.6 and 8.6 of the respective projections 6.5 and 8.5 received in the groove 10.2.

Figure 3:
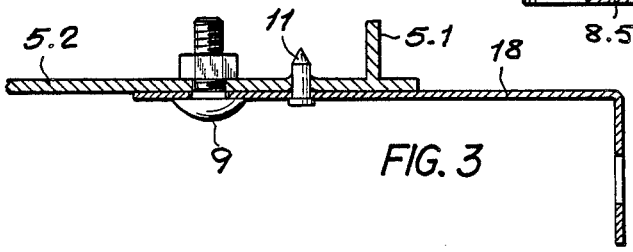
FIG. 3 is a sectional view similar to that of FIG. 2 showing an alternative embodiment for one of the straps.
Figure 4:
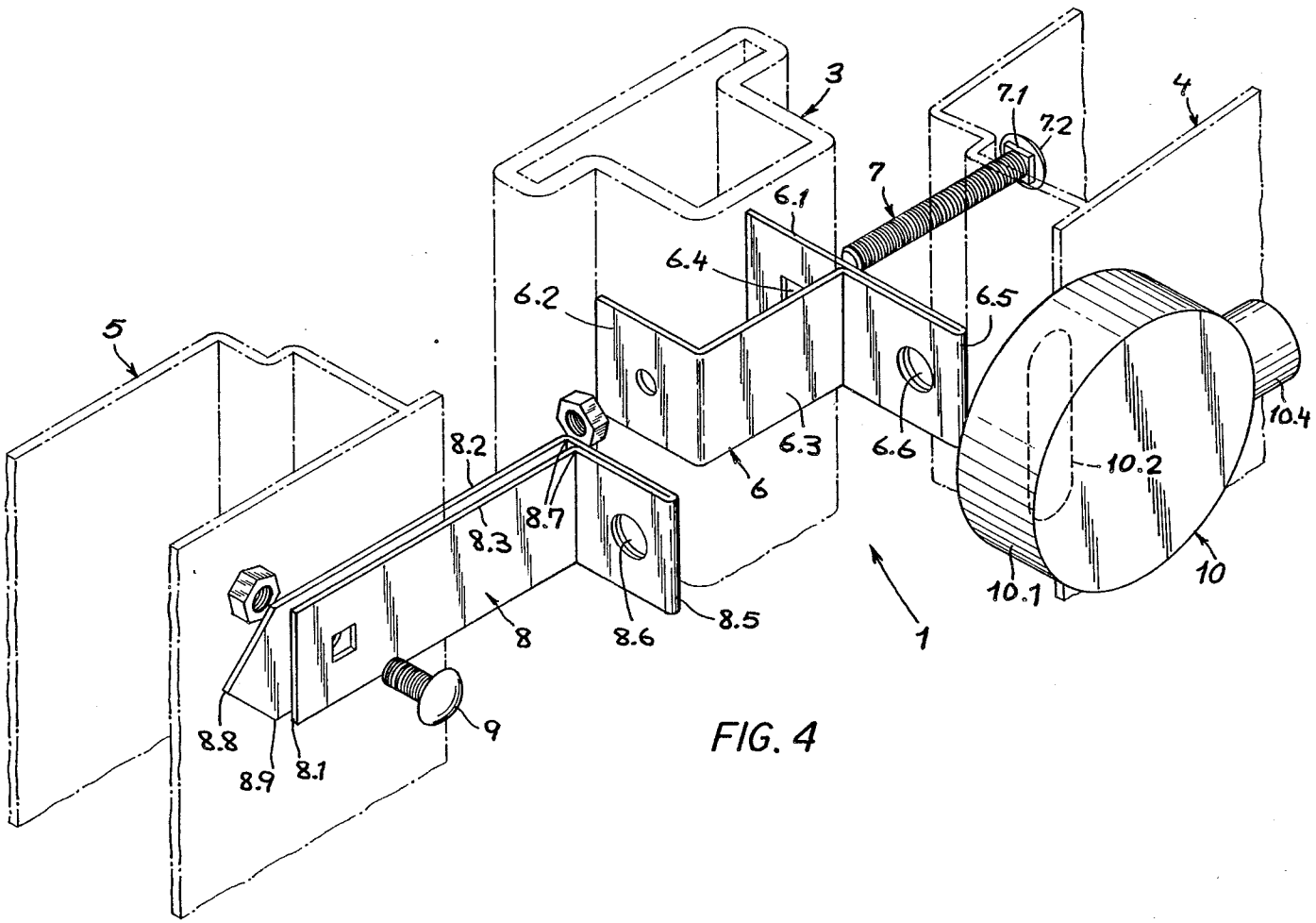
FIG. 4 is an exploded perspective view of the locking assembly of FIG. 1.

In the alternative illustrated in FIG. 3, the L-shaped strap 18 can be formed by a single layered strip and mounted on the surface of the skin 5.2 using the same bolt 9, but with the addition of a spike 11 which traverses the strap 18 and is driven through the skin 5.2 to prevent rotation of the strap 18 around the bolt 9.

Figure 5:
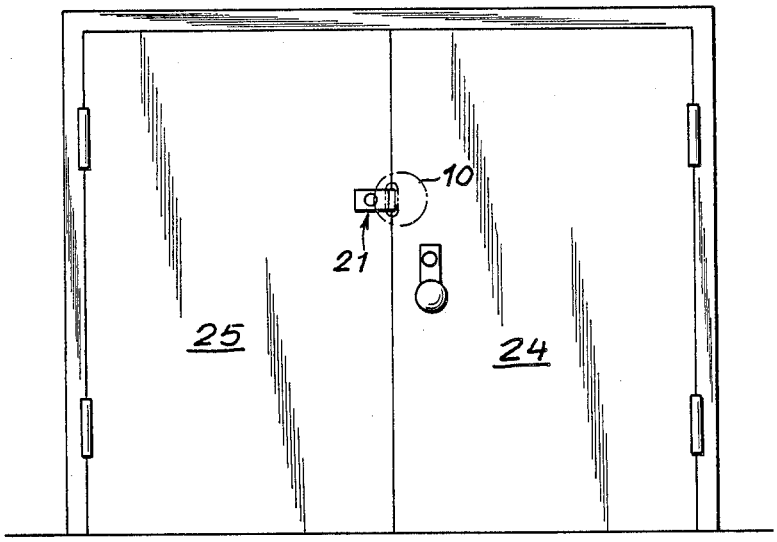
FIG. 5 is a somewhat diagrammatic front elevational view of another embodiment of the locking assembly mounted on a hinged double door, with the lock thereof shown in phantom lines.
Figure 6:
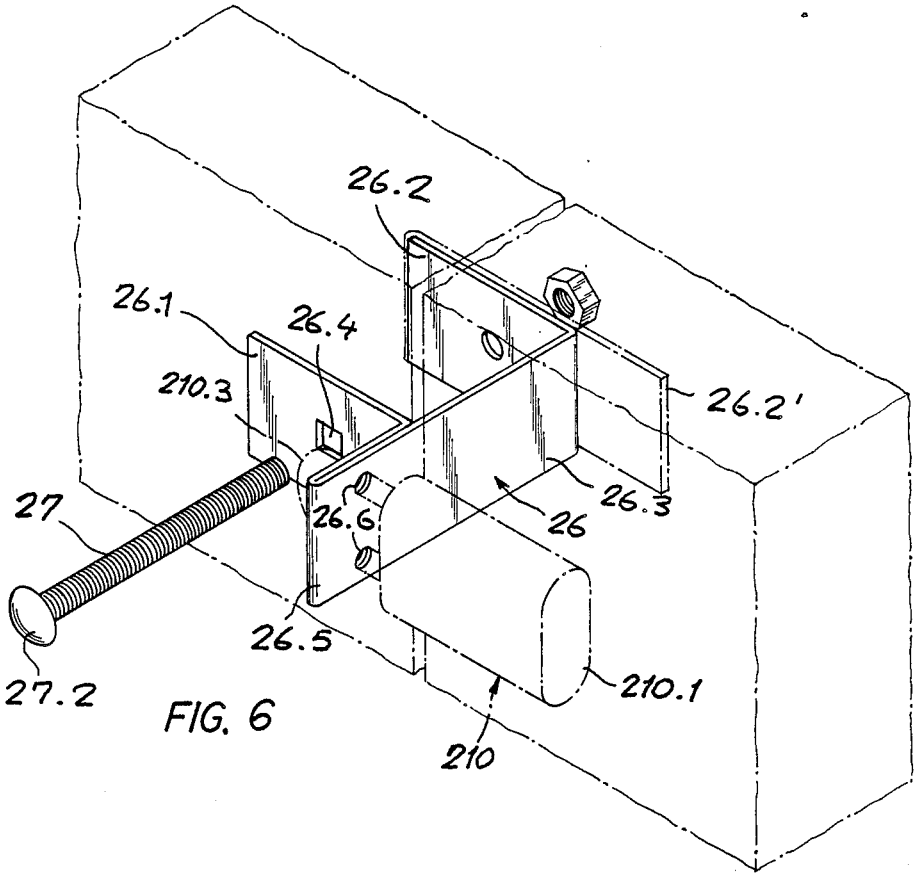
FIG. 6 is an exploded perspective view of the locking assembly of FIG. 5.

FIGS. 5 and 6 illustrate another embodiment of the invention in which a locking assembly 21 requiring only a single strap is directed for use on hinged double doors 24 and 25, where the door 25 is fixed in a stationary position and the door 24 is swingable into an open position.

The locking assembly 21 includes a single strap 26 formed by a single unitary strip having a pair of flanges 26.1 and 26.2 straddling the edge of the stationary door 25 adjacent the swingable door 24 and joined by a web 26.3, which extends beyond the door to form a projection 26.5, at which the strip is folded to form a double layered projection having, merely by way of example, a pair of apertures 26.6 traversed by the shackle 210.3 of a short-shackled lock 210, illustrated in phantom lines in FIG. 6, and having a body 210.1 which acts to block the opening swing of the door 24. The stationary door 25 and the flanges 26.1 and 26.2 are traversed by a bolt 27, similar to the bolt 7, having a square boss formed at the head 27.2 which fits into the square opening 26.4 formed in flange 26.1 and acts to hold the bolt 27 against rotation.

In the case where the door 24 is a swinging door and can swing both ways, a modification of the strap 26 is provided by another flange 26.2', shown in phantom lines in FIG. 6, and formed by a folded over extension of the flange 26.2, which extends into the path of the door 24 and prevents two-way swinging thereof.

Figure 7:
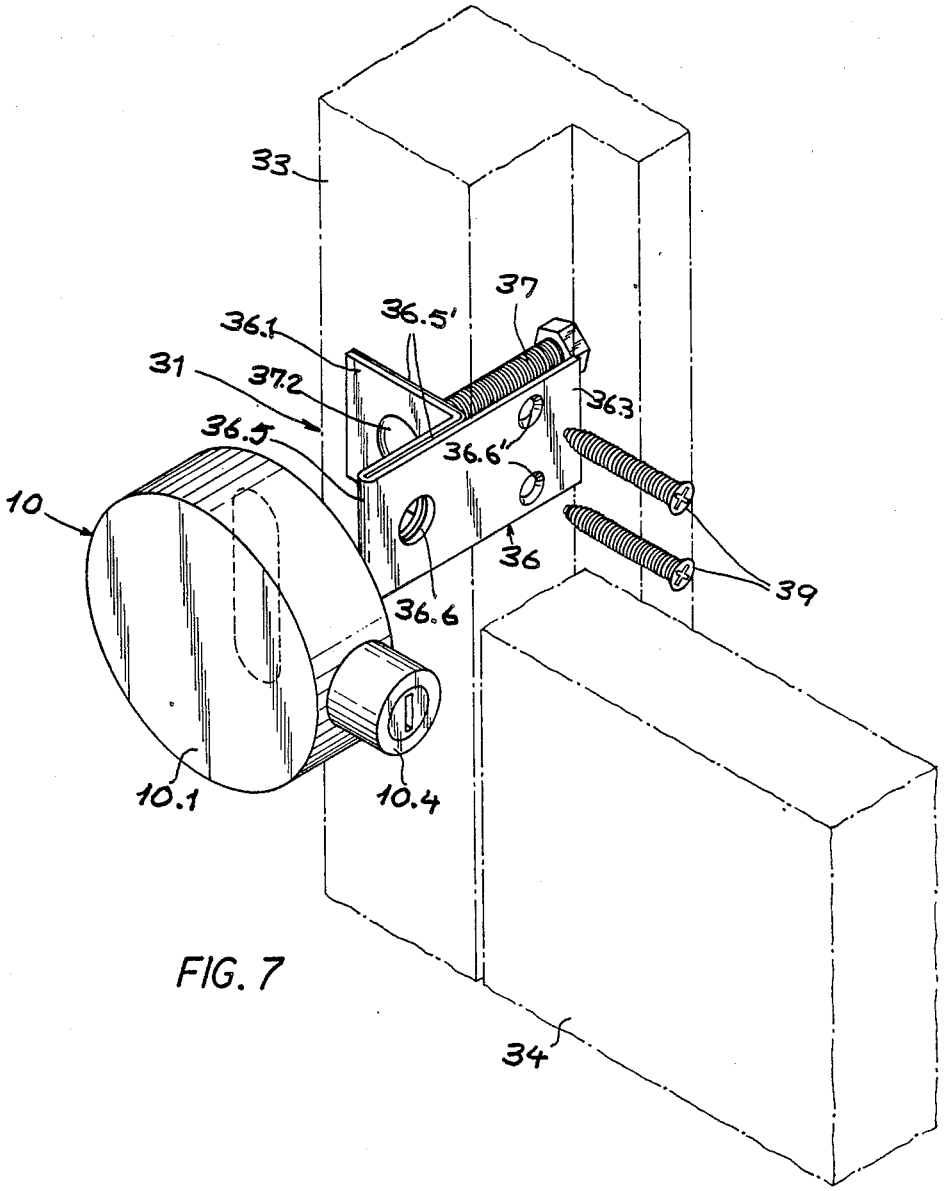
FIG. 7 is an exploded perspective view showing an alternative embodiment of the locking assembly of FIG. 6.

In the case where the door structure comprises a single hinged door 34 hung in a door frame 33 having a shoulder 33.1 acting as a stop for the swingable door 34, as shown in FIG. 7, the locking assembly 31 again includes only a single strap 36 formed by a single unitary strip having a web 36.3 extending beyond the frame 33 to form a projection 36.5, which is folded over to form a double layered projection traversed by an aperture 36.6, with a flange 36.1 extending perpendicularly from the double layered flange 36.5 and traversed, along with frame 33, by a bolt 37 similar to the bolt 7. The web 36.3 is also provided with a pair of apertures 36.6' through which screws 39 can be threaded into the frame 33 transverse to the bolt 37, fastening the strap 36 to the frame 33 from two different directions. Further, a reinforcing layer 36.5' of hardened steel can be provided between the layers of the double layered projection 36.5 and extend around the inwardly facing surface of the flange 36.1, providing a projection which is almost impossible to cut through in an attempted forced entry.

The cylindrical-bodied lock 10 can again be used in this application of the invention in the manner already described, with the lock body 10.1 acting to block the opening swing of the door 34 and to a substantial degree, to block the head 37.2.

It should be obvious from the foregoing descriptions of the various embodiments, that the locking assemblies offer an add-on locking system which is both simple, since with hinged doors only a single strap is needed and the lock body blocks the opening swing of the door, and extremely secure, since the strap always straddles the part of the door structure on which it is mounted and the lock body acts to block, at least to a degree, the head of the mounting bolt, making this locking assembly unique in the art.

I claim:

1. A locking assembly for a door structure having a stationary portion and a hinged portion swingable into an open position past an edge of said stationary position, said locking assembly comprising:

a strap mounted one of said portions and formed with a projection adjacent a separation between said portions and said edge, said projection extending substantially parallel to an opening swing of said hinged portion past said edge, said projection being formed with at least one aperture; and a lock removably mounted on said projection and having a shaft traversing said aperture, said lock having a body which extends across the separation between the portions, directly abutting a surface of the other of said portions adjacent said edge and blocking both portions of said door structure and acting to prevent the opening swing of said hinged portion without being fixed to said other of said portions, said body of said lock being cylindrical and formed with an elongated groove across which said shaft can move transversely, said groove being adapted to receive said projection in a releasably lockable manner while presenting a closed outwardly facing surface.

2. A locking assembly for a door structure having a stationary portion and a hinged portion swingable into an open position, said locking assembly comprising:

a strap mounted on said door structure along at least two adjoining sides thereof and formed with a projection adjacent a separation between said portions and extending substantially parallel to an opening swing of said hinged portion, said projection being formed with at least one aperture; and a lock removably mounted on said projection and having a shaft traversing said aperture, said lock having a body which extends across the separation between the portions, blocking both portions of said door structure and acting to prevent the opening swing of said hinged portion, said strap being mounted on said stationary portion of said door structure along two adjoining sides thereof by a respective flange and a respective web, said flange lying perpendicular to said projection and said web lying parallel to said projection, said flange and said stationary portion being traversed by at least one bolt.

3. The locking assembly defined in claim 2, further comprising a second flange extending from said web in the same direction and parallel to said first mentioned flange and spaced therefrom, said first and second flanges flanking said stationary portion and traversed by said bolt.

4. The locking assembly defined in claim 2 wherein said web is traversed by at least one screw threaded into said stationary portion.

5. The locking assembly defined in claim 2, further comprising another flange extending from said web in a direction opposite to said first mentioned flange, but parallel thereto and offset therefrom for acting as a stop when said hinged portion of said door structure is a swinging door.

6. The locking assembly defined in claim 3 wherein said strap is a single unitary strip which is folded at said projection to form a double layered projection.

7. The locking assembly defined in claim 6 wherein a reinforcing layer is sandwiched between the double layers of said projection and extends along said flange and is traversed by said bolt.

8. A locking assembly for a door structure having a stationary portion and a hinged portion swingable into an open position, said locking assembly comprising:

a strap mounted on said door structure along at least two adjoining sides thereof and formed with a projection adjacent a separation between said portions and extending substantially parallel to an opening swing of said hinged portion, said projection being formed with at least one aperture; and a lock removably mounted on said projection and having a shaft traversing said aperture, said lock having a body which extends across the separation between the portions, blocking both portions of said door structure and acting to prevent the opening swing of said hinged portion, said strap being a single unitary strip which is folded at said projection to form a double layer coextending to a pair of ends remote from said projection, one end of said pair of ends being pointed for driving the associated layer thereof into said door structure, said double layer and said door structure being traversed by a bolt.

9. A locking assembly for a door structure having a stationary portion, a hinged portion swingable into an open position, and a sliding portion slidable into an open position, said locking assembly comprising:

a first strap mounted on said door structure and formed with a first projection adjacent a separation between said hinged portion and an adjacent portion of said door structure and extending substantially parallel to an opening swing of said hinged portion, said projection being formed with at least one first aperture;

a second strap mounted on said sliding portion and formed with a second projection adjacent said first projection in a closed position of said sliding portion and formed with at least one second aperture coaxial with said first aperture; and a lock removably mounted on said first and second projections and having a shaft traversing said first and second apertures and maintaining said sliding portion in the closed position thereof, said lock having a body which extends across said separation, blocking said hinged portion and preventing the opening swing thereof.

10. The locking assembly defined in claim 9 wherein at least one of said straps is a single unitary strip folded at said projection to form a double layer coextending to a pair of ends remote from said projection, one end of said pair of ends being pointed for driving the associated layer thereof into said door structure, said double layer and said door structure being traversed by a bolt.

11. The locking assembly defined in claim 9 wherein said first strap is mounted on said stationary portion of said door structure along three adjoining sides thereof by a pair of flanges flanking opposite sides of said stationary portion and joined by a web, said web lying perpendicular to said first projection and said pair of flanges lying parallel to said first projection, said pair of flanges and said stationary portion being traversed by a bolt.

12. The locking assembly defined in claim 11 wherein said first strap is a single unitary strip which is folded at said first projection to form a double layered projection substantially coplanar with one flange of said pair of flanges.

13. The locking assembly defined in claim 12 wherein said second strap is a single unitary strip folded at said second projection to form a double layer coextending to a pair of ends remote from said second projection, one end of said pair of ends being pointed for driving the associated layer thereof into said sliding portion of said door structure with at least a part of said double layer overlying said web of said first strap, said double layer and said sliding portion being traversed by a second bolt.

14. The locking assembly defined in claim 13 wherein said body of said lock is cylindrical and formed with an elongated groove across which said shaft can move transversely, said groove being adapted to receive said first and second projections in a releasably lockable manner while presenting a closed outwardly facing surface.

* * * * *